US011499354B2

(12) United States Patent
Duer

(10) Patent No.: US 11,499,354 B2
(45) Date of Patent: Nov. 15, 2022

(54) FURNITURE HINGE

(71) Applicant: Julius Blum GmbH, Hoechst (AT)

(72) Inventor: Stefan Duer, Schwarzach (AT)

(73) Assignee: JULIUS BLUM GMBH, Hoechst (AT)

( * ) Notice: Subject to any disclaimer, the term of this patent is extended or adjusted under 35 U.S.C. 154(b) by 0 days.

(21) Appl. No.: 17/316,177

(22) Filed: May 10, 2021

(65) Prior Publication Data

US 2021/0262259 A1 Aug. 26, 2021

Related U.S. Application Data

(63) Continuation of application No. PCT/AT2019/060369, filed on Nov. 5, 2019.

(30) Foreign Application Priority Data

Nov. 13, 2018 (AT) ..... A 50976/2018

(51) Int. Cl.
*E05D 7/04* (2006.01)
*E05D 7/00* (2006.01)

(52) U.S. Cl.
CPC ..... *E05D 7/0054* (2013.01); *E05Y 2900/20* (2013.01)

(58) Field of Classification Search
CPC ..... Y10T 16/532; Y10T 16/5321; Y10T 16/5322; Y10T 16/53225; Y10T 16/5325;
(Continued)

(56) References Cited

U.S. PATENT DOCUMENTS 279,857 A * 6/1883 Campbell ..... E05D 7/0423 16/245
1,900,081 A * 3/1933 Swerer ..... E05D 7/0054 16/242

(Continued)

FOREIGN PATENT DOCUMENTS

CN 2734935 10/2005
CN 1879134 12/2006

(Continued)

OTHER PUBLICATIONS

International Search Report dated Jan. 31, 2020 in International (PCT) Application No. PCT/AT2019/060369.

(Continued)

*Primary Examiner* — Chuck Y Mah
(74) *Attorney, Agent, or Firm* — Wenderoth, Lind & Ponack, LLP

(57) ABSTRACT

A furniture hinge includes a first fitting portion configured to be fixed to a first furniture part, a second fitting portion configured to be fixed to a second furniture part, at least one hinge axis by which the first fitting portion and the second fitting portion are hingedly connected to one another, and at least one adjustment device for adjusting a position of the first fitting portion relative to the second fitting portion. The adjustment device includes at least one movably-supported adjustment element, and the position of the first fitting portion relative to the second fitting portion can be adjusted by an actuation of the at least one adjustment element. Upon actuation of the at least one adjustment element, the position of the first fitting portion and the position of the second fitting portion can be synchronously and symmetrically adjusted in relation to the at least one hinge axis.

15 Claims, 4 Drawing Sheets

(58) Field of Classification Search
CPC . Y10T 16/5327; E05D 7/0054; E05D 7/0018; E05D 7/0027; E05D 7/0045; E05D 7/04; E05D 7/0415; E05D 7/0423; E05Y 2900/20; E05Y 2007/0036; E05Y 2007/0446
See application file for complete search history.

(56) References Cited

U.S. PATENT DOCUMENTS

| | | | | |
|---|---|---|---|---|
| 2,248,372 | A * | 7/1941 | May | E05D 7/0054 16/240 |
| 2,779,966 | A * | 2/1957 | Torchia | E05D 7/0027 16/244 |
| 4,141,109 | A | 2/1979 | Farrell | |
| 5,074,609 | A * | 12/1991 | Dear | E05D 7/0423 296/76 |
| 5,933,919 | A * | 8/1999 | Miller | E05D 7/0018 16/244 |
| 6,212,734 | B1 * | 4/2001 | Commons | E05D 7/0027 16/244 |
| 6,397,432 | B1 * | 6/2002 | di Vinadio | E05D 7/0054 16/241 |
| 6,484,363 | B1 * | 11/2002 | Chung | E05D 7/0054 16/241 |
| 7,162,774 | B1 * | 1/2007 | Von Resch | E05D 7/0054 16/236 |
| 8,375,517 | B1 * | 2/2013 | Johnsen | E05D 7/0027 16/244 |
| 10,012,014 | B2 | 7/2018 | Malott et al. | |
| 2005/0183238 | A1 * | 8/2005 | McCue | E05D 7/0027 16/236 |
| 2008/0104799 | A1 * | 5/2008 | Hoppe | E05D 7/0027 16/238 |
| 2008/0235910 | A1 * | 10/2008 | Um | E05D 5/121 16/382 |
| 2009/0031530 | A1 * | 2/2009 | Barca | E05D 7/0027 16/235 |
| 2011/0296652 | A1 * | 12/2011 | Zhang | E05D 7/04 16/239 |
| 2012/0102674 | A1 * | 5/2012 | King | E05D 7/0423 16/248 |
| 2015/0135480 | A1 * | 5/2015 | Bartels | E05D 3/022 16/237 |
| 2016/0047151 | A1 * | 2/2016 | Pelekanos | E05D 11/0054 16/237 |
| 2016/0273251 | A1 | 9/2016 | Malott et al. | |
| 2017/0247920 | A1 * | 8/2017 | Dolman | E05D 5/0238 |

FOREIGN PATENT DOCUMENTS

| | | | | |
|---|---|---|---|---|
| CN | 201056923 | | 5/2008 | |
| CN | 101956499 | | 1/2011 | |
| CN | 202031419 | | 11/2011 | |
| CN | 204531812 | | 8/2015 | |
| CN | 205822998 | | 12/2016 | |
| EP | 2 020 475 | | 2/2009 | |
| EP | 2687660 | A2 * | 1/2014 | E05D 3/022 |
| EP | 3093422 | A1 * | 11/2016 | E05D 7/1005 |
| GB | 2 069 592 | | 8/1981 | |
| JP | 8-284538 | | 10/1996 | |
| WO | 2014/066929 | | 5/2014 | |

OTHER PUBLICATIONS

Search Report dated Mar. 9, 2022 in corresponding Chinese Patent Application No. 201980074731.1.

* cited by examiner

FURNITURE HINGE

BACKGROUND OF THE INVENTION

The present invention relates to a furniture hinge including a first fitting portion configured to be fixed to a first furniture part, a second fitting portion configured to be fixed to a second furniture part, at least one hinge axis by which the first fitting portion and the second fitting portion are hingedly connected to one another, and at least one adjustment device for adjusting a position of the first fitting portion relative to the second fitting portion. The adjustment device includes at least one movably-supported adjustment element, and the position of the first fitting portion relative to the second fitting portion can be adjusted by an actuation of the at least one adjustment element.

By an adjustment device of the furniture hinge, a relative position of the two fitting portions to one another can be adjusted. Therefore, a gap formed between the furniture parts can be adjusted in a mounted condition of the furniture hinge. By an actuation of an adjustment element, the furniture parts can be adjusted relative to one another in a lateral direction and/or in a height direction and/or in a depth direction in a mounted condition. In any case, the aim of the adjustment to be performed is to align the furniture parts substantially flush or in a common plane to one another in the mounted condition. The adjustment is usually implemented such that a first fitting portion of the furniture hinge remains in a stationary position during the adjustment operation, whereas the second fitting portion of the furniture hinge is moved relative to the first fitting portion by an actuation of the adjustment element. Such a one-sided adjustment leads to the fact that a position of the hinge axis of the furniture hinge is displaced relative to the two furniture parts. This can lead to undesired stresses and blockages of the furniture parts to one another, and finally to an unfavorable kinematics.

U.S. Pat. No. 4,141,109 A discloses a hinge for pivotally supporting a door relative to a stationary frame. The hinge includes two fitting portions configured to be fixed to the furniture parts and a hinge axis member. The two fitting portions are connected to the hinge axis member by supporting arms, and a length of the supporting arms (and therewith a position of the door) can by adjusted by rotatable screws.

SUMMARY OF THE INVENTION

It is an object of the present invention to propose a furniture hinge of the type mentioned in the introductory part, thereby avoiding the drawbacks as discussed above.

According to the invention, upon an actuation of the at least one adjustment element, the position of the first fitting portion and the position of the second fitting portion can be synchronously and symmetrically adjusted in relation to the at least one hinge axis.

In this way, an undesired displacement of the hinge axis in relation to the furniture parts can be prevented, so that the danger of stresses of the furniture parts to one another can be reduced. Moreover, an intuitive adjustment can be afforded, because the fitting portions can be equidistantly adjusted in relation to the hinge axis.

The furniture hinge is, in particular, advantageous for connecting door wings of a folding door to one another. The two door wings are movable to one another between a first position, in which the door wings are aligned coplanar to one another, and second position, in which the door wings are aligned parallel to one another. Due to the symmetrical adjustment of the fitting portions in relation to the hinge axis, it is possible that the door wings, in the second position, are aligned parallel and flush (that is to say, without a lateral offset) to one another, despite the adjustments made.

According to an embodiment, each of the first fitting portion and the second fitting portion can be configured to be adjustable in a direction extending perpendicular to a longitudinal direction of the hinge axis by an actuation of the at least one adjustment element. Thereby, the first fitting portion and the second fitting portion are linearly displaceably supported by an actuation of the at least one adjustment element.

The at least one adjustment element can be rotationally supported, and the fitting portions can be adjusted relative to one another by rotating the adjustment element.

According to an embodiment, the furniture hinge can include a transmission mechanism for converting a rotational movement of the adjustment element into a linear movement of the fitting portions. The conversion of a rotational movement into a linear movement is a known measure for the person skilled in the art. This can be implemented, for example, by a rack-pinion-arrangement, by a worm gear, by a threaded spindle-nut arrangement, by a spiral-shaped track adjustment or by a multiple worm gear. Moreover, the transmission mechanism offers the possibility to vary the transmission ratio. For example, the adjustment element can be driven by a cordless screwdriver at a relatively high speed, and the fitting portions can be driven with a small hub, but with a large force.

According to a possible embodiment, the transmission mechanism includes at least one threaded spindle configured to be rotated by a rotational movement of the adjustment element. At least two threaded nuts are supported on the threaded spindle, and each of the at least two threaded nuts are connected to the two fitting portions in a movement-coupled manner. Each of the at least two threaded nuts can be adjusted along the threaded spindle by an actuation of the adjustment element.

Preferably, the at least one hinge axis of the furniture hinge is configured as a threaded spindle, or includes a threaded portion at least over a region. Alternatively, it is possible that the hinge axis of the furniture hinge and the threaded spindle are configured as components separate from one another.

The movement-coupling between the threaded nuts and the fitting portions can be implemented such, for example, that the first threaded nut is connected in a movement-coupled manner to the first fitting portion via a first pivotally supported lever, and the second threaded nut is connected in a movement-coupled manner to the second fitting portion via a second pivotally supported lever.

As an alternative or in addition, the first fitting portion includes a first inclinedly-extending guide and the second fitting portion includes a second inclinedly-extending guide. The first threaded nut is displaceably supported along the first guide of the first fitting portion and the second threaded nut is displaceably supported along the second guide of the second fitting portion.

According to an embodiment, the furniture hinge includes at least one second adjustment element for adjusting a relative position of the first fitting portion and the second fitting portion. The first adjustment element and the second adjustment element can be spaced from one another along the hinge axis of the furniture hinge. In this way, the adjustment elements can be actuated from different directions. The first adjustment element can thereby be actuated from above in a mounted position with the aid of a tool, whereas the second adjustment element can be actuated from below in a mounted position with the aid of the tool.

With a possible embodiment, the at least one adjustment element can include a tool-receiving device, and the adjustment element can be driven by rotating the tool-receiving device with the aid of a tool, preferably a screwdriver.

The item of furniture according to the invention comprises a furniture carcass and at least two furniture parts movably-supported relative to the furniture carcass, and the at least two furniture parts are hingedly connected to one another by at least one furniture hinge of the described type.

BRIEF DESCRIPTION OF THE DRAWINGS

Further details and advantages of the invention result from the following description of figures, in which.

DETAILED DESCRIPTION OF THE INVENTION

Figure 1:
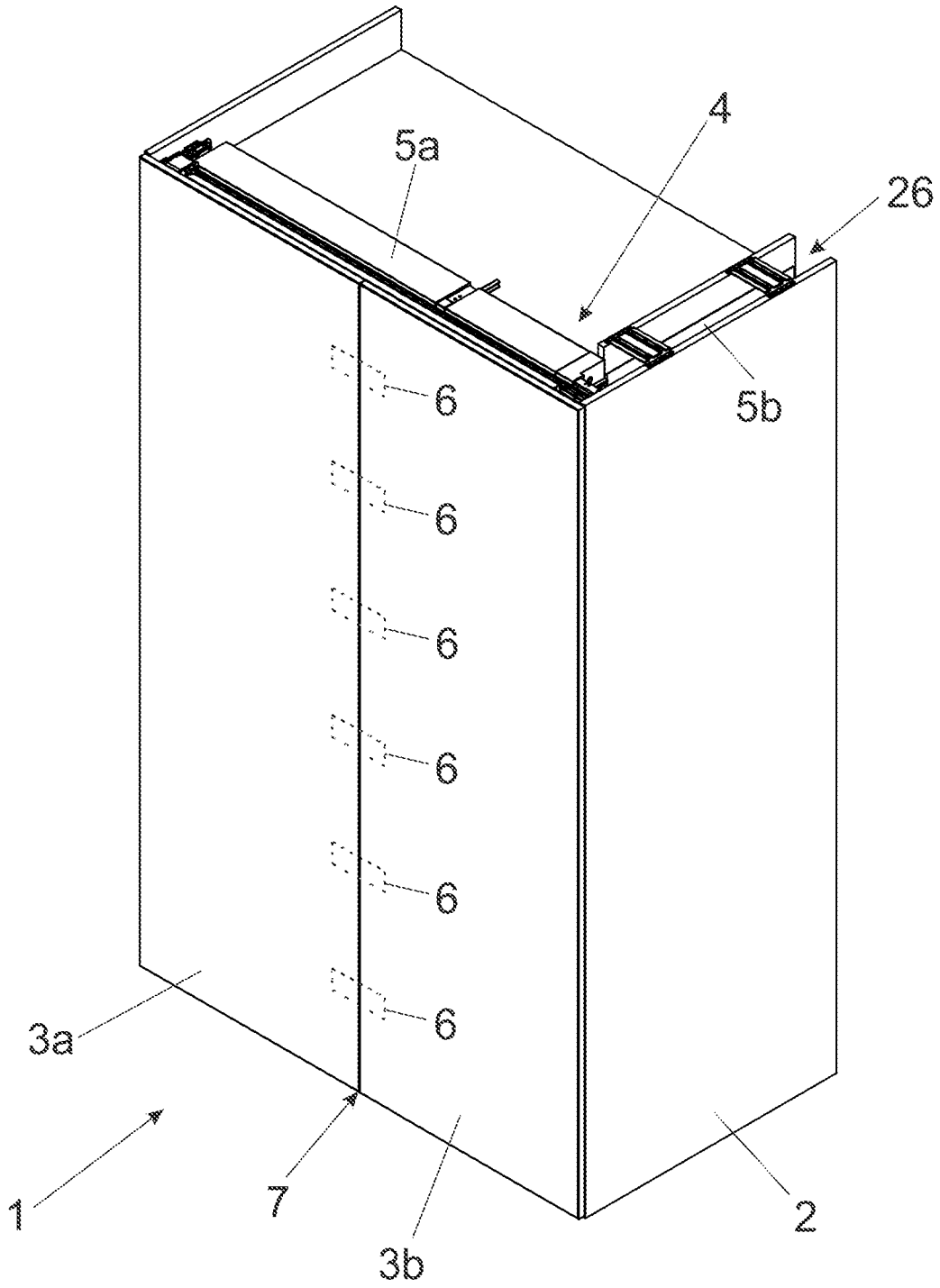
FIG. 1 is a perspective view of an item of furniture comprising a furniture carcass and two furniture parts movably-supported relative to the furniture carcass.

FIG. 1 shows a perspective view of an item of furniture 1 comprising a furniture carcass 2, and two furniture parts 3*a*, 3*b* in the form of door wings are movably supported relative to the furniture carcass 2. By a guide system 4, the furniture parts 3*a*, 3*b* are movable between a first position, in which the furniture parts 3*a*, 3*b* are aligned substantially coplanar to one another, and a second position, in which the furniture parts 3*a*, 3*b* are aligned substantially parallel to one another. In the parallel position to one another, the furniture parts 3*a*, 3*b* can be inserted into a lateral insertion compartment 26 of the furniture carcass 2. The guide system 4 includes a first guide rail 5*a* and a second guide rail 5*b* extending substantially at a right angle to one another in a mounted position. The furniture parts 3*a*, 3*b* are displaceably supported between the first position and the second position along the guide rails 5*a*, 5*b*. The two furniture parts 3*a*, 3*b* are hingedly connected to one another by a plurality of furniture hinges 6. The furniture hinges 6 are arranged on the rear side of the furniture parts 3*a*, 3*b* and are spaced from one another in a height direction. By at least one adjustment device 21 (FIG. 2*d*) of the furniture hinge 6, a width of a, preferably substantially vertically extending, gap 7 formed between the furniture parts 3*a*, 3*b* can be adjusted. This adjustment is implemented such that the position of the first furniture part 3*a* and the position of the second furniture part 3*b* can be synchronously and symmetrically adjusted relative to a hinge axis 11 of the furniture hinge 6. The symmetrical adjustment is especially advantageous, because the furniture parts 3*a*, 3*b* in the second position, in which the furniture parts 3*a*, 3*b* are aligned substantially parallel to one another, shall also adopt a flush position to one another. With a non-symmetrical adjustment of the furniture hinge 6, the hinge axis 11 of the furniture hinge 6 would be displaced relative to the furniture parts 3*a*, 3*b* such that a parallel position of the furniture parts 3*a*, 3*b* to one another would be prevented. This could then cause stress or blockage of the furniture parts 3*a*, 3*b*, leading to an unfavorable kinematics of the furniture parts 3*a*, 3*b*.

Figure 2A:
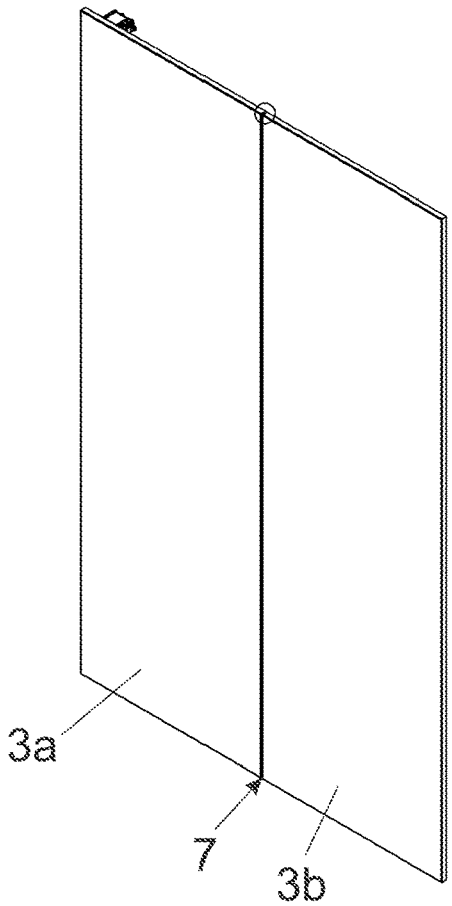
FIG. 2*a*-2*d* show the furniture parts with two gaps having a different width, and an exploded view of the relevant components of the furniture hinge.
Figure 2B:
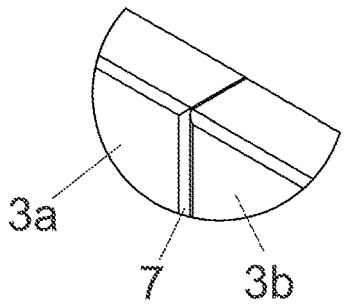
Figure 2C:
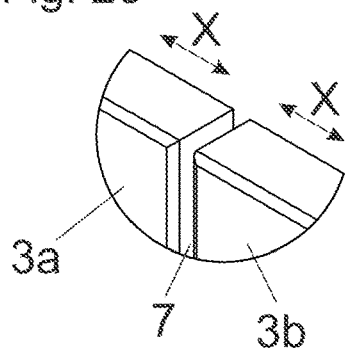

FIG. 2*a* shows the furniture parts 3*a*, 3*b* in a coplanar position to one another, and a vertically extending gap 7 is formed between the furniture parts 3*a*, 3*b*. FIG. 2*b* shows an enlarged view of the region encircled in FIG. 2*a*, in which a width of the gap 7 between the furniture parts 3*a*, 3*b* is set to minimum. By an actuation of the adjustment element 10 of the furniture hinge 6, the furniture parts 3*a*, 3*b* can be synchronically and symmetrically adjusted in relation to the hinge axis 11 of the furniture hinge 6 in a lateral direction (X). FIG. 2*c* shows the furniture parts 3*a*, 3*b*, in which the width of the gap 7 between the furniture parts 3*a*, 3*b* is set to maximum.

Figure 2D:
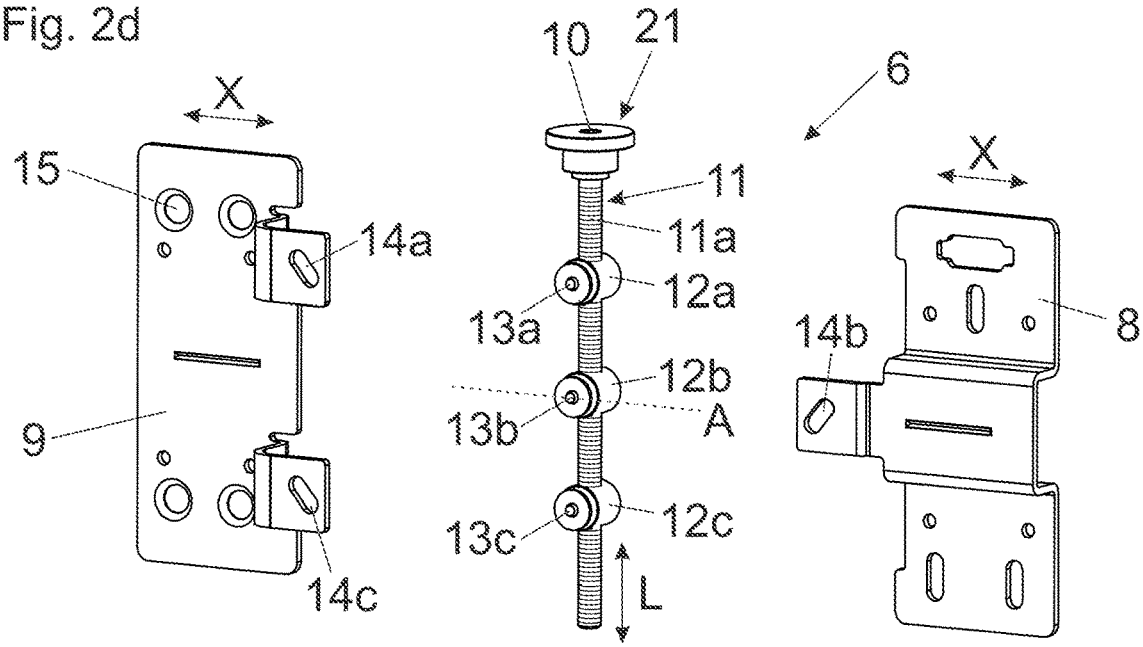

FIG. 2*d* shows the relevant components of the furniture hinge 6 in an exploded view. The furniture hinge 6 includes a first fitting portion 8 configured to be fixed to the first furniture part 3*a* and a second fitting portion 9 configured to be fixed to the second furniture part 3*b*. The first fitting portion 8 and/or the second fitting portion 9 can include at least one or a plurality of fastening location(s) 15 for fixing to the furniture parts 3*a*, 3*b*. The fastening location(s) 15 of the fitting portions 8, 9 can be configured, for example, as holes for receiving screws. The fitting portions 8, 9 are hingedly connected to one another by at least one hinge axis 11 having a longitudinal direction (L). In the shown embodiment, the hinge axis 11 is configured as a transmission mechanism including a threaded spindle 11*a* which is in threading engagement with three threaded nuts 12*a*, 12*b*, 12*c*. By a rotation of the adjustment element 10, the threaded spindle 11*a* can be rotated, whereby the threaded nuts 12*a*, 12*b*, 12*c* can be moved along the threaded spindle 11*a* in the longitudinal direction (L). On each of the threaded nuts 12*a*, 12*b*, 12*c*, pins 13*a*, 13*b*, 13*c* are arranged. The pins 13*a*, 13*b*, 13*c* are configured to be guided in or along inclinedly-extending guides (inclined slots) 14*a*, 14*b*, 14*c* of the fitting portions 8, 9. Accordingly, upon a rotation of the adjustment element 10, the threaded spindle 11*a* can also be rotated, whereby the threaded nuts 12*a*, 12*b*, 12*c* are movable along the threaded spindle 11*a*. Therefore, the fitting portions 8, 9 can be synchronously and symmetrically adjusted in a lateral direction (X), preferably in a direction perpendicular to the longitudinal direction (L) of the hinge axis 11, due to the pins 13*a*, 13*b*, 13*c* displaceably supported in the guides 14*a*, 14*b*, 14*c*.

In the shown embodiment, the rotational axis of the adjustment element 10 is arranged coaxial to the longitudinal direction (L) of the hinge axis 11. Alternatively, it is also possible that the rotational axis of the adjustment element 10 and the longitudinal direction (L) of the hinge axis 11 are arranged laterally offset to one another. In the case of a lateral offset between the adjustment element 10 and the threaded spindle 11*a*, a mechanical transmission (for example a gear transmission or a worm transmission) can be interposed so as to vary the transmission ratio.

In the shown embodiment, the guides 14*a*, 14*b*, 14*c* are each configured as longitudinal holes (slots), preferably having an inclination of approximately 45°. The guides 14*a*, 14*c* of the second fitting portion 9 extend substantially parallel to one another, whereas the guide 14*b* of the first fitting portion 8 is configured to be mirror-symmetrical relative to the guides 14*a*, 14*c* of the second fitting portion 9. The threaded nut 12*b* for guiding the first fitting portion 8 is arranged on a notional middle plane (A) of the hinge axis 11, whereas each of the threaded nuts 12*a*, 12*c* is arranged symmetrically to the middle plane (A). In this way, a uniformly-acting and tilting-free adjustment of the fitting portions 8, 9 to one another can be afforded.

Figure 3A:
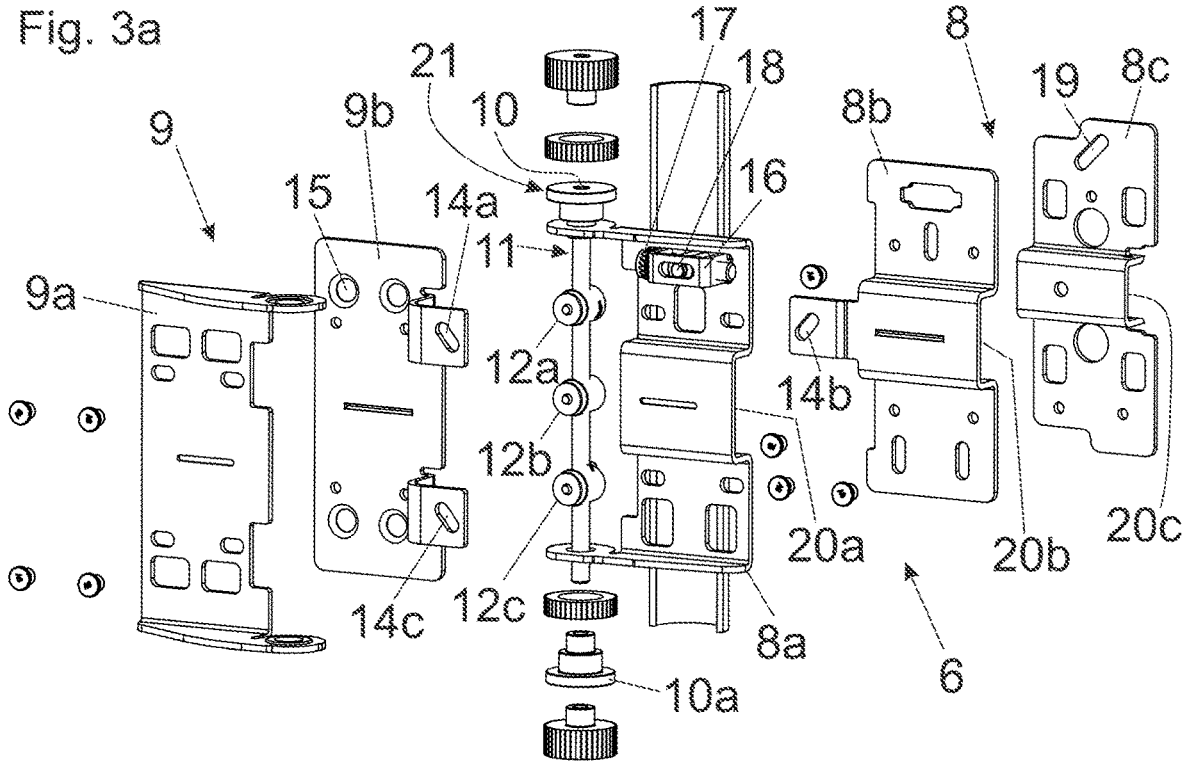
FIG. 3*a*, 3*b* show a possible embodiment of the furniture hinge in an exploded view and in a perspective view.

FIG. 3*a* shows a possible embodiment of a furniture hinge 6 in an exploded view. Each of the two fitting portions 8, 9 can have a two-part or a multi-part configuration and includes a fitting element 8*a*, 9*a* pivotally arranged about the hinge axis 11. Adjustment plates 8*b*, 9*b* are arranged on the fitting elements 8*a*, 9*a*, the adjustment plates 8*b*, 9*b* being configured to be adjustable in a direction extending perpendicular to the hinge axis 11. The adjustment plates 8*b*, 9*b* can be configured to be identical as the fitting portions 8, 9 shown in FIG. 2*d*. In the shown figure, in addition to the first adjustment element 10, a second adjustment element 10*a* is provided. The hinge axis 11 configured as a threaded spindle 11*a* is configured to be rotated by a rotation of the first adjustment element 10 as well as by a rotation of the second adjustment element 10*a*. The first adjustment element 10 and the second adjustment element 10*a* are spaced from one another along the hinge axis 11 of the furniture hinge 6. Moreover, the two adjustment elements 10, 10*a* are arranged to be actuated from different directions, for example from above and from below in the mounted position. Upon a rotation of one adjustment element 10, 10*a*, the threaded nuts 12*a*, 12*b*, 12*c* supported on the threaded spindle 11*a* can be moved. The pins 13*a*, 13*b*, 13*c* of the threaded nuts 12*a*, 12*b*, 12*c* shown in FIG. 2*d* are displaceably guided in the inclined guides 14*a*, 14*b*, 14*c* and move the two adjustment plates 8*b*, 9*b* synchronically and symmetrically relative to the hinge axis 11.

The fitting element 8*a* pivotable about the hinge axis 11 includes a first U-shaped section 20*a* in which a second U-shaped section 20*b* of the adjustment plate 8*b* is displaceably guided. This allows a precise linear movement of the adjustment plate 8*b* relative to the fitting element 8*a* in a direction extending perpendicular to the hinge axis 11. For a height adjustment of the fitting portions 8, 9 to one another, a further adjustment plate 8*c* having a third U-shaped section 20*c* is provided. The third U-shaped section 20*c* of the adjustment plate 8*c* is received with clearance in a height direction within the second U-shaped section 20*b* of the adjustment plate 8*b*. A height adjustment device 16 is arranged on the fitting element 8*a*, and a height position of the two fitting portions 8, 9 to one another can be adjusted by the height adjustment device 16. The height adjustment device 16 includes a pin 18 configured to be linearly displaceable upon a rotation of a tool receiving device 17. The pin 18 engages into an inclinedly extending guide 19 arranged on the adjustment plate 8*c*. Upon a rotation of the tool receiving device 17, the pin 18 is displaced with respect to the guide 19 of the adjustment plate 8*c*, whereby the fitting element 8*a*, jointly with the adjustment plate 8*b*, can be elevated and lowered relative to the adjustment plate 8*c* due to the height clearance which is present between the second U-shaped section 20*b* and the third U-shaped section 20*c*. In this way, the two furniture parts 3*a*, 3*b*, in a connected condition with the fitting portions 8, 9, can be adjusted relative to one another in a height direction.

Figure 3B:
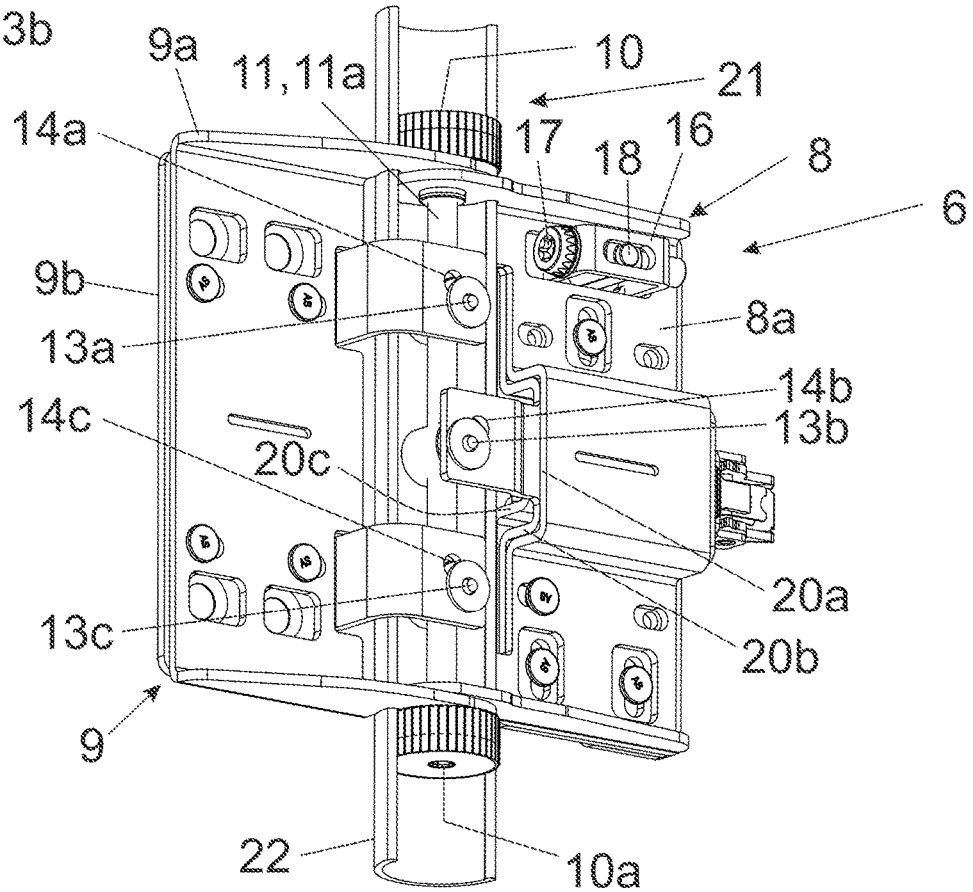

FIG. 3*b* shows the furniture hinge 6 according to FIG. 3*a* in a perspective view. It can be clearly seen that the second U-shaped section 20*b* of the adjustment plate 8*b* is glidingly guided within the first U-shaped section 20*a* of the fitting element 8*a*. The third U-shaped section 20*c* of the adjustment plate 8*c* is received within the second U-shaped section 20*b* of the adjustment plate 8*b* with a clearance in the height direction. This allows the relative position between the fitting element 8*a* and the adjustment plate 8*c* to be adjusted in a height direction by rotating the tool receiving device 17.

Moreover, a, preferably curved-shaped, cover 22 is provided, the cover 22 being configured to be releasably connected, preferably snapped, to the furniture hinge 6. By the lengthy cover 22, a gap 7 formed between the furniture parts 3*a*, 3*b* can be at least partially covered. According to an embodiment, it can be provided that a pivotal movement of the cover 22 about the hinge axis 11 is coupled to a movement of the furniture hinge 6, so that the cover 22 also adopts a different pivotal position depending on the position of the fitting portions 8, 9 to one another.

Figure 4A:
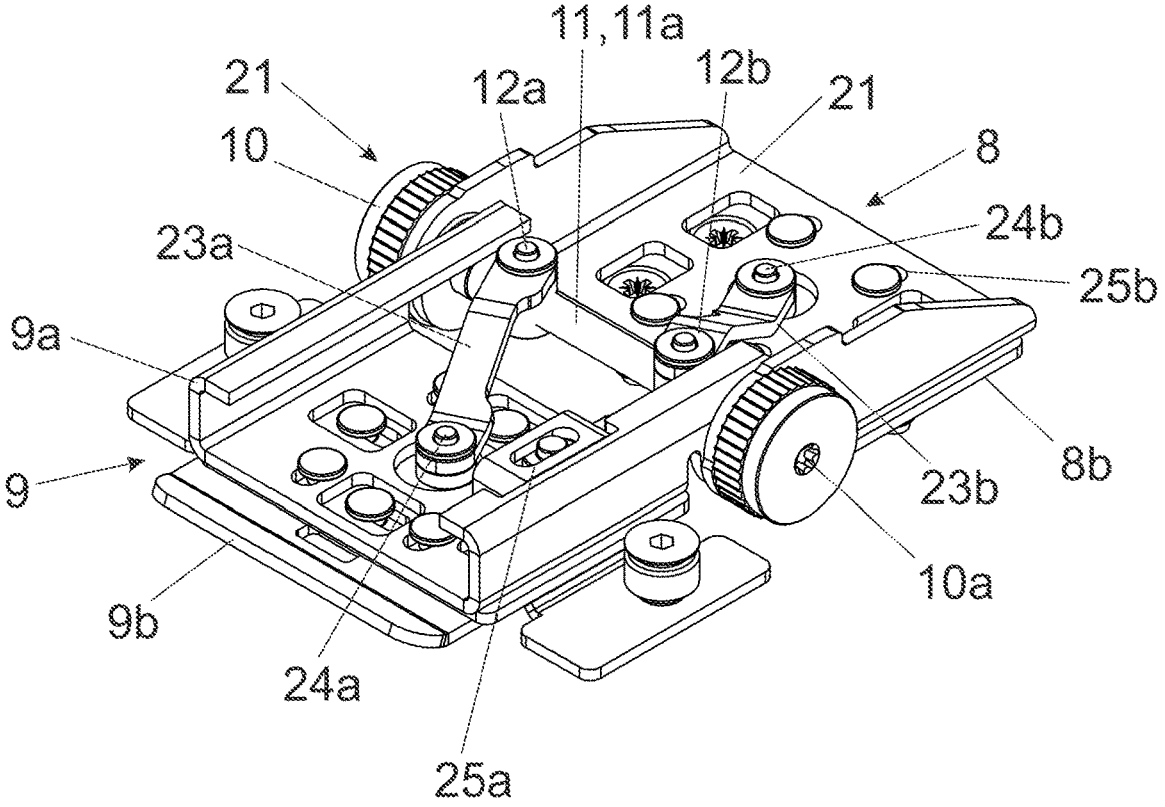
FIG. 4*a*, 4*b* show a further embodiment of the furniture hinge with different relative positions of the fitting portions to one another.
Figure 4B:
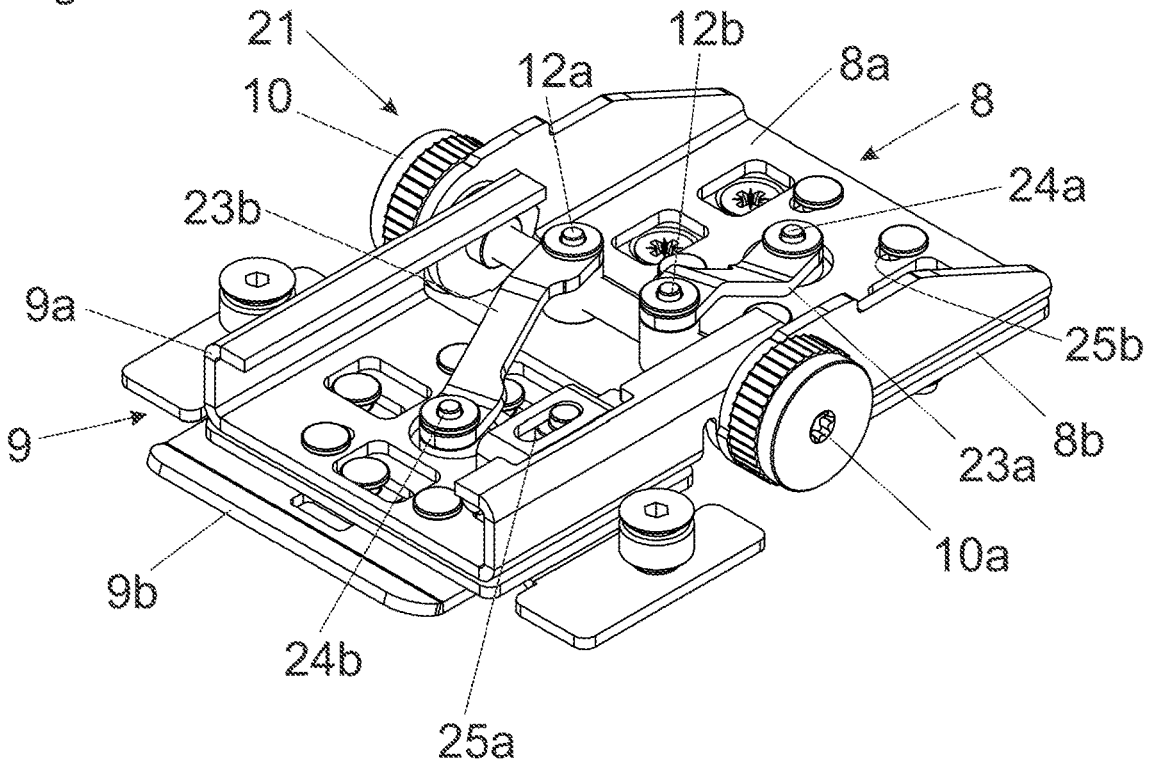

FIG. 4*a* and FIG. 4*b* show a further embodiment of a furniture hinge 6 with two different relative positions of the fitting portions 8, 9 to one another. The fitting portions 8, 9 include fitting elements 8*a*, 9*a* which are pivotally supported about the hinge axis 11. Adjustment plates 8*b*, 9*b* are arranged on the fitting elements 8*a*, 9*a*, the adjustment plates 8*b*, 9*b* being displaceably supported relative to the fitting elements 8*a*, 9*a*. Here, the hinge axis 11 is again configured as a threaded spindle 11*a* on which two threaded nuts 12*a*, 12*b* are supported. Instead of the inclinedly extending guides 14*a*, 14*b*, 14*c*, two pivotable levers 23*a*, 23*b* are here provided for converting a linear movement of the adjustment plates 8*b*, 9*b*. A first lever 23*a*, one the one hand, is pivotally connected to the threaded nut 12*b*, and, on the other hand, is pivotally connected to the adjustment plate 8*b* by a first joint 24*a*. The second lever 23*b*, one the one hand, is pivotally connected to the threaded nut 12*a*, and, on the other hand, is pivotally connected to the adjustment plate 9*b* by a second joint 24*b*. By a rotation of an adjustment element 10, 10*a*, the threaded nuts 12*a*, 12*b* are movable along the threaded spindle 11*a*. The adjustment plates 8*b*, 9*b* can be moved by the levers 23*a*, 23*b* relative to the fitting elements 8*a*, 9*a* with a high force transmission. The adjustment plates 8*b*, 9*b* can be precisely guided relative to the fitting elements 8*a*, 9*a* by at least one linear guide 25*a*, 25*b* in a direction extending perpendicular to the hinge axis 11.

Moreover, it can be provided that, in addition to the adjustment device 21 for adjusting a lateral position of the fitting portions 8, 9 to one another and in addition to the height adjustment device 16, a further adjustment device (not shown in the drawings) can be provided for adjusting the fitting portions 8, 9 in a depth direction to one another.

The invention claimed is:

1. A furniture hinge, comprising:

a first fitting portion configured to be fixed to a first furniture part, a second fitting portion configured to be fixed to a second furniture part, a hinge axis hingedly connecting the first fitting portion and the second fitting portion to one another, an adjustment device for adjusting a position of the first fitting portion relative to the second fitting portion, the adjustment device including a movably-supported adjustment element, and configured such that the position of the first fitting portion relative to the second fitting portion is adjustable by an actuation of the adjustment element, wherein, upon the actuation of the adjustment element, the position of the first fitting portion and the position of the second fitting portion are synchronously and symmetrically adjusted relative to the hinge axis.

2. The furniture hinge according to claim 1, wherein each of the first fitting portion and the second fitting portion are adjustable in a direction extending perpendicular to a longitudinal direction of the hinge axis upon an actuation of the adjustment element.

3. The furniture hinge according to claim 1, wherein each of the first fitting portion and the second fitting portion is linearly displaceably adjusted upon an actuation of the adjustment element.

4. The furniture hinge according to claim 1, wherein the adjustment element is rotationally supported.

5. The furniture hinge according to claim 4, further comprising a transmission mechanism for converting a rotational movement of the adjustment element into a linear movement of the fitting portions.

6. The furniture hinge according to claim 5, wherein the transmission mechanism includes a threaded spindle configured to be rotated by a rotational movement of the adjustment element.

7. The furniture hinge according to claim 6, wherein the transmission mechanism further includes at least two threaded nuts supported on the threaded spindle, the at least two threaded nuts being adjustable along the threaded spindle by an actuation of the adjustment element.

8. The furniture hinge according to claim 7, wherein a first one of the at least two threaded nuts is connected to the first fitting portion in a movement-coupled manner, and a second one of the at least two threaded nuts is connected to the second fitting portion in a movement-coupled manner.

9. The furniture hinge according to claim 7, wherein a first one of the at least two threaded nuts is connected to the first fitting portion in a movement-coupled manner via a first pivotally supported lever, and a second one of the at least two threaded nuts is connected to the second fitting portion in a movement-coupled manner via a second pivotally supported lever.

10. The furniture hinge according to claim 8, wherein the first fitting portion includes an inclined first guide, and the second fitting portion includes an inclined second guide, wherein the first one of the at least two threaded nuts is displaceably supported along the first guide of the first fitting portion, and the second one of the at least two threaded nuts is displaceably supported along the second guide of the second fitting portion.

11. The furniture hinge according to claim 6, wherein the transmission mechanism includes at least three threaded nuts supported on the threaded spindle, wherein two threaded nuts of the at least three threaded nuts are connected to one of the first fitting portion and the second fitting portion in a movement-coupled manner.

12. The furniture hinge according to claim 1, wherein the adjustment element is a first adjustment element, the furniture hinge further comprising a second adjustment element for adjusting a relative position of the first fitting portion and the second fitting portion.

13. The furniture hinge according to claim 12, wherein the first adjustment element and the second adjustment element are spaced from one another in a longitudinal direction of the hinge axis of the furniture hinge.

14. The furniture hinge according to claim 1, further comprising a height adjustment device for adjusting a height position of the first fitting portion relative to the second fitting portion.

15. An item of furniture comprising:

a furniture carcass;

at least two furniture parts movably-supported relative to the furniture carcass; and the furniture hinge according to claim 1 hingedly connecting the at least two furniture parts to one another.

* * * * *